United States Patent [19]

Nielsen

[11] 4,427,406

[45] Jan. 24, 1984

[54] SECTIONAL SHAPED LINER FOR A CENTRIFUGE ROTOR

[75] Inventor: Steven T. Nielsen, Sunnyvale, Calif.

[73] Assignee: Beckman Instruments, Inc., Fullerton, Calif.

[21] Appl. No.: 360,550

[22] Filed: Mar. 22, 1982

[51] Int. Cl.[3] ..... B04B 5/02

[52] U.S. Cl. ..... 494/16; 494/45

[58] Field of Search ..... 494/45, 31, 33, 34, 494/16, 17, 18, 21

[56] References Cited

U.S. PATENT DOCUMENTS

| | | | |
|---|---|---|---|
| 3,096,283 | 7/1963 | Hein | 494/38 |
| 3,239,136 | 3/1966 | Hein | 494/1 |
| 3,724,747 | 4/1973 | Unger | 494/45 |
| 4,056,225 | 11/1977 | Hein, Jr. | 494/33 |
| 4,142,670 | 3/1979 | Ishimaru et al. | 494/38 |
| 4,301,963 | 11/1981 | Nielsen | 494/16 |

*Primary Examiner*—Robert W. Jenkins

*Attorney, Agent, or Firm*—Robert J. Steinmeyer; Ferd L. Mehlhoff; William H. May

[57] ABSTRACT

A one piece integrally formed sectional shaped liner for use in combination with similarly shaped sectional liners in a generally cylindrical chamber of a centrifuge rotor. The utilization of a plurality of similarly shaped plastic liners within a single rotor chamber allows for the placement of different fluid samples in a single rotor during one centrifuge run. The liners are designed in such a manner that they do not require a separate capping means and are preferably made through a blow molding process. The liners are designed to provide adjacent support to each other during the centrifugation run.

11 Claims, 8 Drawing Figures

SECTIONAL SHAPED LINER FOR A CENTRIFUGE ROTOR

BACKGROUND OF THE INVENTION

The present invention is directed to fluid sample containers for placement in a centrifuge rotor and, more particularly, is directed to the concept of a sectorial or sectional shaped plastic liner for placement in a single cylindrical chamber within the centrifuge rotor.

Presently used containers for fluid samples that are to be subjected to centrifugation offer the user a variety of approaches for placement of the samples in the rotor. In the case of a fixed angle centrifuge rotor wherein a plurality of separate cavities are placed radially around the spin axis of the rotor, a plurality of separate centrifuge tubes can be placed in these cavities to carry different or various samples. In some smaller rotors such as the Airfuge® centrifuge rotor, the cavities for receipt of the centrifuge are very small and, therefore, the volume of the sample to be centrifugated is available only in a very small quantity. In order to provide more volume, a single cavity rotor is available for use, but the liner designed for that centrifuge will accept only a single fluid sample. Therefore, if it is desirable to centrifuge a sample having more volume than found in the small tubes used in the Airfuge centrifuge rotor, it is necessary to make a single centrifuge run for each sample that is placed in the single large liner.

It has normally been considered necessary to provide solid exterior support to any liner placed in the rotor. In other words, the exterior of a sample carrying liner or a centrifuge tube used in the rotor must be supported. Otherwise, the liner or tube may deform and break under the tremendous centrifugal forces generated by the rotor operating at speeds as high as 180,000 rpms. Consequently, the rotor typically has had to be specifically designed to accommodate the particular shaped liner used.

SUMMARY OF THE INVENTION

The present invention is directed to a generally cylindrical sectional shaped liner which is designed to be placed within a single cylindrical chamber in a centrifuge rotor. The sectional shaped liner is designed for use in conjunction with other similarly shaped sectional shaped liners to provide the complete occupation of the cavity within the rotor. Since the liners are preferably made of a thermoplastic material, they are not strong enough to retain any structural integrity during centrifugation if not supported. However, the placement of a plurality of sample carrying sectional shaped liners within the rotor cavity in side-by-side relationship will provide the necessary support for each liner.

The utilization of sectional shaped liners for placement within a single large cylindrical cavity within the rotor provides the user or operator with an opportunity to place larger volumes of different fluid samples within the rotor for subjection to a single centrifugation run. Depending upon the quantity of each fluid sample for analysis, the size of the cylindrical section can be a quarter or less up to even a half of the cylindrical area within the rotor chamber. In some instances, if only a small amount of a fluid sample is to be subjected to centrifugation, adjacent liners can be filled with a non-sample fluid to provide the necessary support and balance the rotor. The present invention provides a unique alternative between the use of a very small centrifuge tube which does not carry enough volume for the different fluid samples and the use of a single large liner which allows for only one fluid sample. The present invention allows flexibility in the choice of a sample carrying container which can accommodate the size and volume required for the particular analytical investigation required.

In one embodiment of the invention the use of a section shape is important, because the sides of the section are aligned with the radii of the rotor from the spin axis of the rotor so that during centrifugation the particles will be sedimented in this radial direction and interaction with the walls of the liner is minimized.

In an alternate embodiment of the invention each section shaped liner may have two cavities wherein, after the centrifugation run, the heavier material will be separated into one chamber and the lighter material will be separated into another chamber.

DETAILED DESCRIPTION OF THE INVENTION

Figure 1:
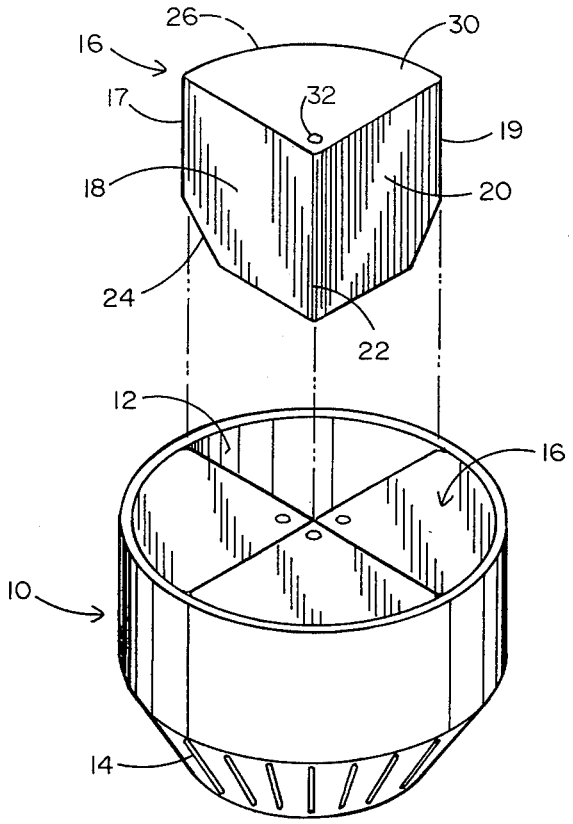
FIG. 1 is a perspective view showing a centrifuge rotor with a plurality of fluid sample liners of the present invention.

FIG. 1 shows an air driven centrifuge rotor 10 having a single interior cylindrical cavity 12. The rotor has a plurality of flutes 14 which are designed to receive high pressured air for driving the rotor at speeds as high as 180,000 r.p.m.'s. Although this particular type of rotor is shown, it should be noted that the present invention is equally applicable to any particular rotor which has one or more cylindrical cavities. Other types of applicable rotors would include batch or bowl rotors that are normally designed for use with a single liner for single fluid sample analysis during each centrifugation run. However, the present invention increases the versatility of a rotor having a cylindrical cavity with the provision of several discrete sample holding liners in a single cylindrical cavity. This allows the placement of a plurality of different fluid samples within the same internal cylindrical cavity.

As shown in FIG. 1, a plurality of sectorial or sectional shaped liners 16 are placed within the single cavity 12 of the rotor 10. In the arrangement shown in FIG. 1, the generally cylindrical section shaped liners 16 are designed to be quadrant shaped to occupy approximately 90° each of the circumference of the cavity 12. Each of the liners 16 has vertical flat side walls 18 and 20 which are designed to be in alignment with the radius of the chamber 12. The two side walls 18 and 20 have one common vertical or apex edge 22 which is designed to be placed adjacent or approximately coincident with the spin axis of the rotor. The other vertical edges 17 and 19 of the respective walls 18 and 20 are connected to an arcuate wall 26 of the liner 16. It can be seen that, when the fluid sample is placed within a liner 16, the majority of the sample will be located at some distance from the spin axis of the rotor, since the volume within the liner adjacent the edge or apex 22 will be very small or minimal.

Figure 2:
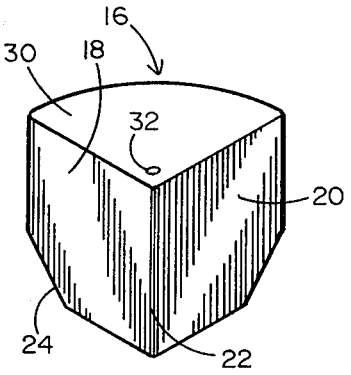
FIG. 2 is a perspective view of one embodiment of the present invention.
Figure 3:
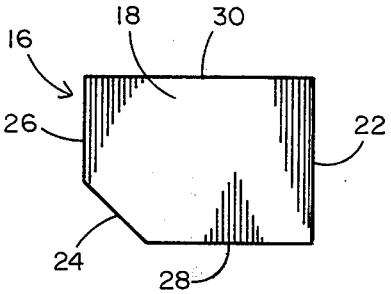
FIG. 3 is a side elevation view of the embodiment of the present invention of FIG. 2.

As shown in FIGS. 2 and 3, the liner 16 has a slight tapered area 24 between its outside cylindrical wall 26 and its bottom 28 so that the liner will conform to the bottom of the cavity 12 in the rotor. Located in the top 30 of the liner 16 is a fill hole 32. It is envisioned that the liners will be made of a thermoplastic material such as low density polyethylene and will be made by the process known as blow molding. Consequently, the fill hole 32 may represent the blow hole for use in the manufacture of the liner. It is envisioned that the outside cylindrical wall 26 and the bottom 28, as well as any slanted wall 24, will be designed to mate completely and be supported completely by the interior cofiguration of the cavity or chamber 12.

As shown in FIG. 1, the present invention is designed in such a manner that a plurality of the liners 16 are to be utilized in conjunction with each other in the rotor cavity 12. Consequently, although the liner is made of a thermoplastic material, the respective side walls 18 and 20 of each of the liners will provide support to each other during centrifugation. Each of the liners will contain a fluid sample which will provide internal support to each of the liners as well as the proper balance to the rotor. If it is desirable to utilize only two of the liners filled with a fluid sample, it would be possible to fill the other two liners with appropriate non-sample fluid to provide adjacent liner support and the requisite balance for the proper rotor operation.

Figure 4:
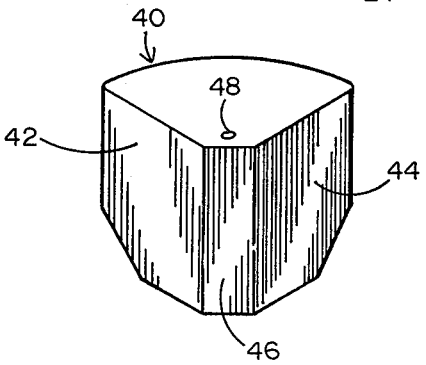
FIG. 4 is a perspective view of an alternate embodiment of the present invention.
Figure 5:
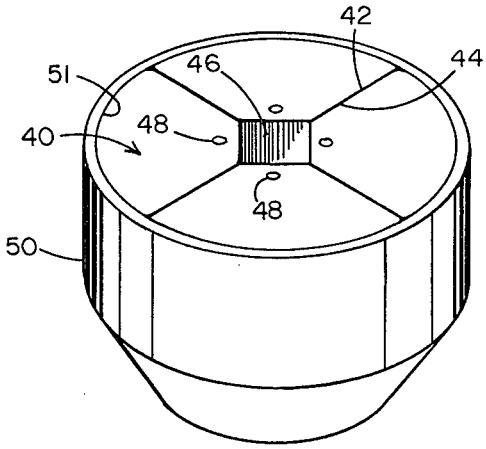
FIG. 5 is a perspective view of a rotor with a plurality of liners having the alternate embodiment configuration of FIG. 4.

Attention is directed to FIG. 4 showing an alternate embodiment of the present invention wherein the liner 40 has side walls 42 and 44 that are designed for alignment with the radius of the rotor cavity into which the liners are to be placed. Although similar to the liner 16 shown in FIG. 1, the alternate liner 40 has a truncated flat face or surface 46 which joins the side walls 42 and 44. As shown in FIG. 5, a plurality of rotor liners 40 with fill holes 48 are placed within a centrifuge rotor 50 having an interior single cylindrical cavity 51 similar to that shown with respect to rotor 10 in FIG. 1. The respective side walls 42 and 44 of the liners 40 provide support to each other during centrifugation. The utilization of the truncated surface 46 provides a slight spacing between the liner 40 and the center of the rotor cavity 51. If the center of the cavity is aligned with the spin axis of the rotor, all of the fluid sample is ensured of displacement from the spin axis and will be in a centrifuge force field. Also, the utilization of the truncated front surface 46 will provide additional strength to the liner.

Figure 6:
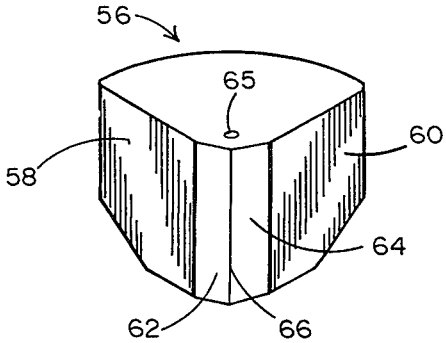
FIG. 6 is a perspective view of a second alternate embodiment of the present invention.
Figure 7:
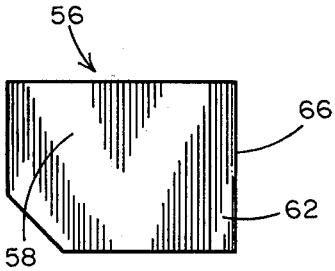
FIG. 7 is a side elevation view of the second embodiment of FIG. 6.

Reference is made to FIGS. 6 and 7 showing a second alternate embodiment liner 56 of the present invention wherein the side walls 58 and 60 join at an angled or curved truncated area or areas 62 and 64. Except for the truncated area, the second alternate liner 56 is similar to the liner 16 of FIG. 1 and includes a fill hole 65. The apex junction 66 in FIGS. 6 and 7 may either be a junction line or a curved area between the faces 62 and 64. This particular configuration will provide greater strength to the truncated portion of the liner during centrifugation. When the liner is made of a flexible material, it may not distort as much as the embodiments shown in FIGS. 1–5 if the liner is not completely filled with the fluid sample. The truncated area, if not supported by the fluid sample, may collapse in an awkward manner with folds and creases which in some instances may entrap the sample particles. Consequently, the truncated arrangement shown in FIGS. 6 and 7 may provide for a slightly stronger liner wherein the distortion would be minimized. However, it should be noted that the truncated arrangement in FIGS. 4 and 5 is envisioned to be of sufficient strength to prevent distortion.

Figure 8:
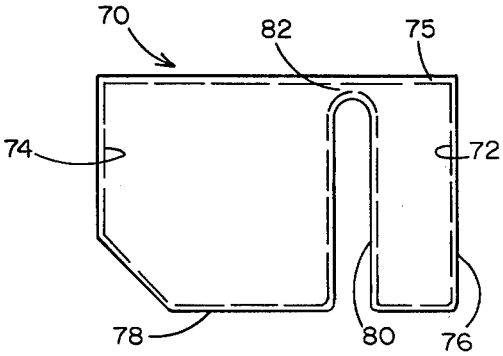
FIG. 8 is a side elevation view of a third alternate embodiment of the present invention.

Another embodiment 70 of the present invention is shown in FIG. 8 having a first chamber 72 and a second chamber 74. It is envisioned that the general configuration of the liner 70 would be similar to that shown in FIG. 2 with a section shaped arrangement and a fill hole 75. However, first chamber 72 would be formed near the liner apex 76 which would be in alignment with and adjacent to the spin axis of the rotor. The bottom 78 of the liner would project up into a double wall area 80 to form the first chamber 72 and the second chamber 74. There would be an opening 82 between the first chamber 72 and the second chamber 74 to allow fluid communication between the chambers. It would be possible, therefore, during centrifugation that the heavier material would be centrifugated into the second chamber 74 while the lighter material would be found in the first chamber 72. Consequently, a plurality of liners 70 can be placed in the rotor and allow for the separation between the lighter and heavier constituents in the fluid samples during centrifugation and their separation would be maintained subsequent to the centrifugation run.

In the operation of the present invention, it is envisioned that the user will in all cases completely fill the rotor chamber 12 in FIG. 1 with a plurality of liners 16. However, if the operator would find that he requires only two of the liners to be filled with fluid samples, similarly shaped and balanced liners would be placed in the rotor adjacent the sample holding liners. Once the centrifugation run is completed, each individual section of the liner 16 can be removed for separate analysis of each of the separate fluid samples within each liner. It is envisioned that each of the embodiments shown in FIGS. 1–8 would be utilized in the same manner wherein the respective side walls of the liners would provide support to one another during centrifugation within the rotor.

Although it has been mentioned that the liner would be preferably a thermoplastic material such as low density polyethylene, the liners could be made from any particular material that would be compatible with the utilization of the rotor. Also, the particular size or applicability of the present invention to particular sized rotors is not important; however, it would appear that these liners would be utilized in a relatively small rotor such as the Airfuge centrifuge rotor which has a diameter of a few inches. It is envisioned that the liners, when made of a low density polyethylene for use in a small diameter rotor, would have a thickness of approximately 6 to 10 thousandths of an inch in the outer walls while the thickness may tend to increase slightly toward the apex of the liner.

What is claimed is:

1. A sectional shaped centrifuge rotor liner for placement in a single cylindrical cavity of a centrifuge rotor with other similarly shaped liners, said sectional shaped liner comprising:

an apex edge formed by the junction of two walls of said liner, said apex edge of said liner being aligned with the spin axis of said rotor when said liner is placed in said rotor; and an annular side of said liner positioned adjacent the wall of said rotor cavity farthest from said spin axis, the portion of said liner adjacent said annular side holding more fluid sample than the portion of said liner adjacent said apex edge, so that the majority of the fluid sample within said liner will be displaced at some radial distance from said spin axis of said rotor when said rotor is operating.

2. In combination, a plurality of centrifuge rotor liners designed for cooperative use with each other to fill a generally cylindrical cavity within a centrifuge rotor, each of said liners comprising at least two vertical walls which are oriented in such a manner that said walls intersect each other at the spin axis of said rotor when said each of said liners is placed in said rotor cavity, said vertical walls of each liner being supported by the vertical walls of the other of said adjacent liners in said rotor cavity.

3. A centrifuge rotor liner as defined in claims 1 or 2, wherein four of said liners are placed within said centrifuge rotor, each of said liners occupying one-fourth of said cylindrical cavity.

4. A centrifuge rotor liner as defined in claims 1 or 2, wherein said liner is sectorial shaped.

5. A centrifuge rotor liner as defined in claims 1 or 2, wherein said liner comprises an inner chamber and an outer chamber.

6. A centrifuge rotor assembly comprising:

a rotor having a single cylindrical cavity; and a plurality of sample carrying rotor liners positioned within said cavity, each of said liners providing lateral support to adjacent liners within said rotor during centrifugation, each of said liners comprises a sectorial shaped container with a truncated wall spaced from the spin axis of said rotor leaving an annular space between said spin axis and said truncated walls of said plurality of rotor liners.

7. A centrifuge rotor assembly as defined in claim 6, wherein said truncated wall is flat.

8. A centrifuge rotor assembly as defined in claim 6, wherein said truncated wall has a generally convex shape projecting toward said spin axis.

9. A sectional shaped centrifuge rotor liner for placement in a single cylindrical cavity of a centrifuge rotor with at least one other similarly shaped liner, said liner comprising:

at least one flat surface intersecting the spin axis of said rotor when placed in said rotor; and an annular side of said liner for mating and supporting contact with the cylindrical wall of said cavity of said rotor, said one flat surface being supported within said rotor by the flat surface of said other similarly shaped liner in said rotor.

10. A sectional shaped centrifuge rotor liner for placement in a single cylindrical chamber of a centrifuge rotor with at least one other similarly shaped liner, said liner comprising:

at least one vertical flat surface; and at least one vertical curved surface, said flat surface contacting a flat surface of said similarly shaped liner when in said rotor, said contacting flat surfaces supporting each other during centrifugation.

11. A sectional shaped centrifuge rotor liner for placement in a single cylindrical cavity of a centrifuge rotor with other similarly shaped liners, said sectional shaped liner comprising:

at least two vertical walls oriented in such a manner with respect to each other that a plane contiguous and parallel to the surface of one wall and a plane contiguous and parallel to the surface of the other wall intersect each other to form a line that is parallel and approximately coincident with the spin axis of said rotor when said liner is placed in said rotor; and a truncated wall spaced from said spin axis and joining said two vertical walls, said truncated wall forming a space between said liner and said spin axis within said rotor.

* * * * *